US006351867B1

(12) United States Patent
Forster

(10) Patent No.: US 6,351,867 B1
(45) Date of Patent: Mar. 5, 2002

(54) BODY SQUEEGEE

(76) Inventor: Gerard A. Forster, 26A Carl St., Lake Ronkonkoma, NY (US) 11779

( * ) Notice: Subject to any disclaimer, the term of this patent is extended or adjusted under 35 U.S.C. 154(b) by 0 days.

(21) Appl. No.: 09/574,416

(22) Filed: May 19, 2000

(51) Int. Cl.[7] ..... A47K 7/02

(52) U.S. Cl. ..... 15/121; 15/227; 15/245; 2/158; 2/160; 2/161.6; 601/137

(58) Field of Search ..... 15/121, 227, 245; 2/158, 160, 161.6, 163; 601/137, 138

(56) References Cited

U.S. PATENT DOCUMENTS

| | | | | | |
|---|---|---|---|---|---|
| 742,440 | A | * | 10/1903 | Johnson | 2/158 X |
| 1,530,327 | A | * | 3/1925 | Redlick | 15/227 X |
| 4,091,491 | A | | 5/1978 | Hoffman | 15/227 |
| 4,364,142 | A | * | 12/1982 | Pangle | 15/121 X |
| 4,757,556 | A | * | 7/1988 | Girard | 2/160 |
| 4,787,113 | A | * | 11/1988 | Kamenske | 15/245 |
| 4,807,322 | A | | 2/1989 | Littledeer | 15/121 |
| 4,893,373 | A | * | 1/1990 | Kato | 15/245 |
| 5,564,154 | A | | 10/1996 | Cohn, III | 15/227 |

FOREIGN PATENT DOCUMENTS

| | | | |
|---|---|---|---|
| GB | 1597837 | * | 9/1981 |

* cited by examiner

*Primary Examiner*—Mark Spisich
(74) *Attorney, Agent, or Firm*—Sharon F. Barkume

(57) ABSTRACT

A hand wearable body squeegee comprising a glove portion, a concave squeegee band, and a linear squeegee band. The concave squeegee band is formed to contour along the surface area between the forefinger sleeve and the thumb sleeve of the glove portion. The linear squeegee band is formed along the surface area along the pinky sleeve and body towards the opening of the glove portion. The glove portion is constructed from water absorbent material and the squeegee bands are constructed from rubber. An additional feature is that the sleeves each contain a hole for drainage of water. The hole may be located in the area of the sleeve that covers the nail portion of a human hand, or at the end of the sleeve opposite the connection to the body.

9 Claims, 4 Drawing Sheets

BODY SQUEEGEE

BACKGROUND OF THE INVENTION

This invention relates to a hand wearable glove used for drying one's body and more specifically to a hand wearable glove made from an absorbent material that incorporates a concave squeegee for drying small body parts and a linear squeegee for drying larger flatter body parts.

Convenience is the driving force for many consumer purchases in the market these days. Any item that saves time or makes life easier for today's overextended workers is a valuable commodity. Most people use at least one and typically two or more towels for drying themselves after a daily shower, and it isn't uncommon for athletes, outdoorsmen and physical labors to take two or three showers a day. This results in the collection and laundering of a large quantity of bulky towels on a daily basis, which is a laborious task for today's busy people. The present invention provides a convenient way of drying one's body without the use of towels, thereby decreasing laundering time and making life easier. The present invention is a body squeegee that is used after a shower to dry one's body. The body squeegee is a glove, made from absorbent material, which is worn on the hand of the user. The glove has two bands, one located between the thumb and forefinger that is concave allowing the band to fit snuggly against smaller body parts, and one located on the side of the pinky and hand that is linear allowing the band to easily wipe larger body parts. After the user dries their body, the glove is simply rinsed out with water, squeezed to eliminate the excess water, and dried by air or with a blow dryer.

In addition to decreasing laundering, this way of drying the body would be relaxing and soothing. The body squeegee would also prevent the pulling and rubbing of skin that results when drying one's body with a towel; therefore, it may eliminate premature wrinkling of the skin. The body squeegee would also prevent rapid changes in body temperature, reducing the potential for catching a cold.

Other additional advantage to the body squeegee is that it is lightweight and compact, allowing it to be much more easily stored than a bulky towel. This is convenient when packing a suitcase for a trip or a gym bag for a daily workout. Not only is the body squeegee more convenient and healthful than towels, is saves energy and money due to reduced laundering.

Gloves for various functions have been available for many years. For example, U.S. Pat. No. 4,843,652 to Kuwahara, describes a mesh glove with an absorbing material on a front portion for wiping perspiration from the face and body of runners and exercisers; U.S. Pat. No. 5,564,154 to Cohn, III, describes a bathing glove with a shampoo shield for bathing infants and small children comprising a web member extending between the thumb receptacle and the finger receptacle adjacent to the thumb receptacle, where the web member is liquid impermeable and used for diverting water from the child's face; and U.S. Pat No. 4,807,322 to Littledeer, describes a mitt with a squeegee for the removal of frost off the surface of a windshield. None of the gloves (or mitts) described above are directed towards drying one's body with a glove that incorporates a unique squeegee system. The unique squeegee system is provided by two squeegee bands, first a concave squeegee band between the thumb and forefinger for drying small areas, and second a linear squeegee band on the outside of the pinky and along the length of the hand for drying larger areas.

It is therefore an object of the present invention to provide a hand wearable glove that can wipe and absorb water from one's body.

It is a further object of the present invention to provide a hand wearable glove that is absorbent and that incorporates a concave squeegee band for drying smaller areas and a linear squeegee band for drying larger flatter areas.

It is still a further object of the present invention to provide a hand wearable glove that is easily cleaned and dried.

SUMMARY OF THE INVENTION

In accordance with these and other objects, the present invention is a hand wearable body squeegee comprising a glove portion, a concave squeegee band, and a linear squeegee band. The glove portion is formed to substantially conform to a human hand, and comprises a body with an opening for inserting a human hand, a forefinger sleeve, a thumb sleeve, and a pinky sleeve all attached to the body so as to allow insertion of a human hand. The concave squeegee band is formed to contour substantially along the surface area between the forefinger sleeve and the thumb sleeve of the glove portion. The linear squeegee band is formed along the surface area along the pinky sleeve and body towards the opening of the glove portion.

The glove portion may be constructed from water absorbent material called synthetic microporous PVA material, and the squeegee band may be constructed from rubber.

The glove further comprises two sleeves for a middle finger and a ring finger, wherein both sleeves are also attached to the body to allow each finger of a human hand to be inserted into an associated sleeve. In an alternative embodiment, the pinky sleeve, the ring finger sleeve, the middle finger sleeve, and the forefinger sleeve may be joined as one large sleeve to form a mitt.

An additional feature of the present invention is that the sleeves each contain at least one hole for drainage of water. The hole may be located in the area of the sleeve that covers the nail portion of a human hand, or at the end of the sleeve opposite the connection to the body.

DETAILED DESCRIPTION OF THE PREFERRED EMBODIMENT

Figure 1:
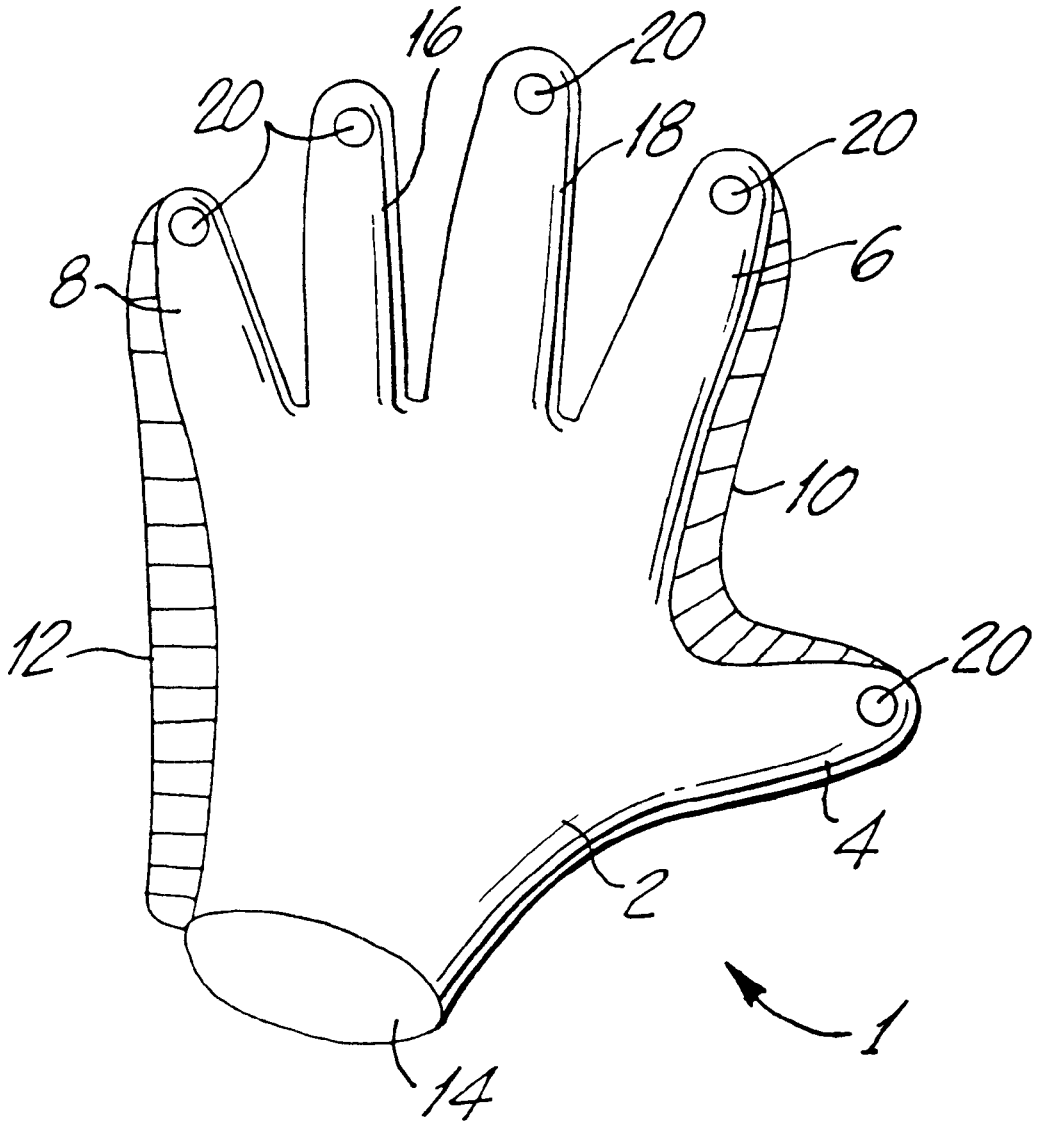
FIG. 1 is a diagram of the preferred embodiment of the present invention.

Shown in FIG. 1 is the preferred embodiment of the body squeegee 1 of the present invention. The body squeegee 1 fulfills the need for a more convenient way for a person at home or a patron of a hotel, health club, or similar establishment to dry his or her body after showering, bathing, exercising, swimming, etc. The body squeegee 1 comprises a glove portion 2, a concave squeegee band 10, and a linear squeegee band 12. In the preferred embodiment, the glove portion 2 contains a sleeve for each finger of the user's hand, i.e. thumb sleeve 4 for the user's thumb, forefinger sleeve 6 for the user's forefinger, middle finger sleeve 18 for the user's middle finger, ring finger sleeve 16, for the user's ring finger, and pinky sleeve 8 for the user's pinky finger. The sleeves that are essential to the design of the body squeegee are the thumb sleeve 4, the forefinger sleeve 6, and the pinky sleeve 8. The thumb sleeve 4 and the forefinger sleeve 6 guide the concave squeegee band 10, and the pinky sleeve 8 in conjunction with the side of the hand guide the linear squeegee band 12. The middle finger sleeve 18 and the ring finger sleeve 16 are not necessarily needed and the glove portion 2 may contain openings that allow the middle finger and ring finger to slide through the glove portion 2. In the preferred embodiment the middle finger sleeve 18 and the ring finger sleeve 16 are present for greater water absorption and for aesthetic reasons. The glove portion 2 and the sleeves 4, 6, 20, 16, and 8 are produced from a water-absorbent material, similar to a sponge, and the squeegee bands 10 and 12 are produced from rubber. The concave squeegee band 10 and the linear squeegee band 12 wipe the water from the skin as a window squeegee wipes water off a window. The water is then absorbed into the glove portion 2 or drizzled to the floor of the shower off the end of the squeegee bands 10 and 12 or through the glove portion 2. Since the glove portion 2 is water absorbent, it may be used to further dry areas missed by the squeegee bands 10 and 12, and the sleeves 4, 6, 20, 16, and 8, also water absorbent, may be used to dry hard to access areas such as between the toes.

Also shown in FIG. 1 is an opening 14 for insertion of a user's hand, and drainage holes 20 in each of the sleeves 4, 6, 20, 16, and 8. The drainage holes 20 are located on the fingertips to allow for quicker drainage. After use, the body squeegee 1 is easily wrung and may be air-dried or dried with a blow dryer. Because the body squeegee 1 is easily rinsed and dried it is a more sanitary method of drying one's body then using towels.

The appealing features of the body squeegee 1 is its effectiveness, convenience, portability, light weight compact size, and practicality, as well as its ability to eliminate the use of towels to dry the body, thus saving time and energy by reducing the collection and laundering of a large quantity of towels on a daily basis. In addition to reducing towel usage, the body squeegee is much smaller and more convenient to carry. An individual exercising several nights a week could simply carry the body squeegee in his/her gym bag, thus eliminating any need to carry or use a towel. It would also no be lightweight and compact to be easily stored and transported while traveling.

Figure 2:
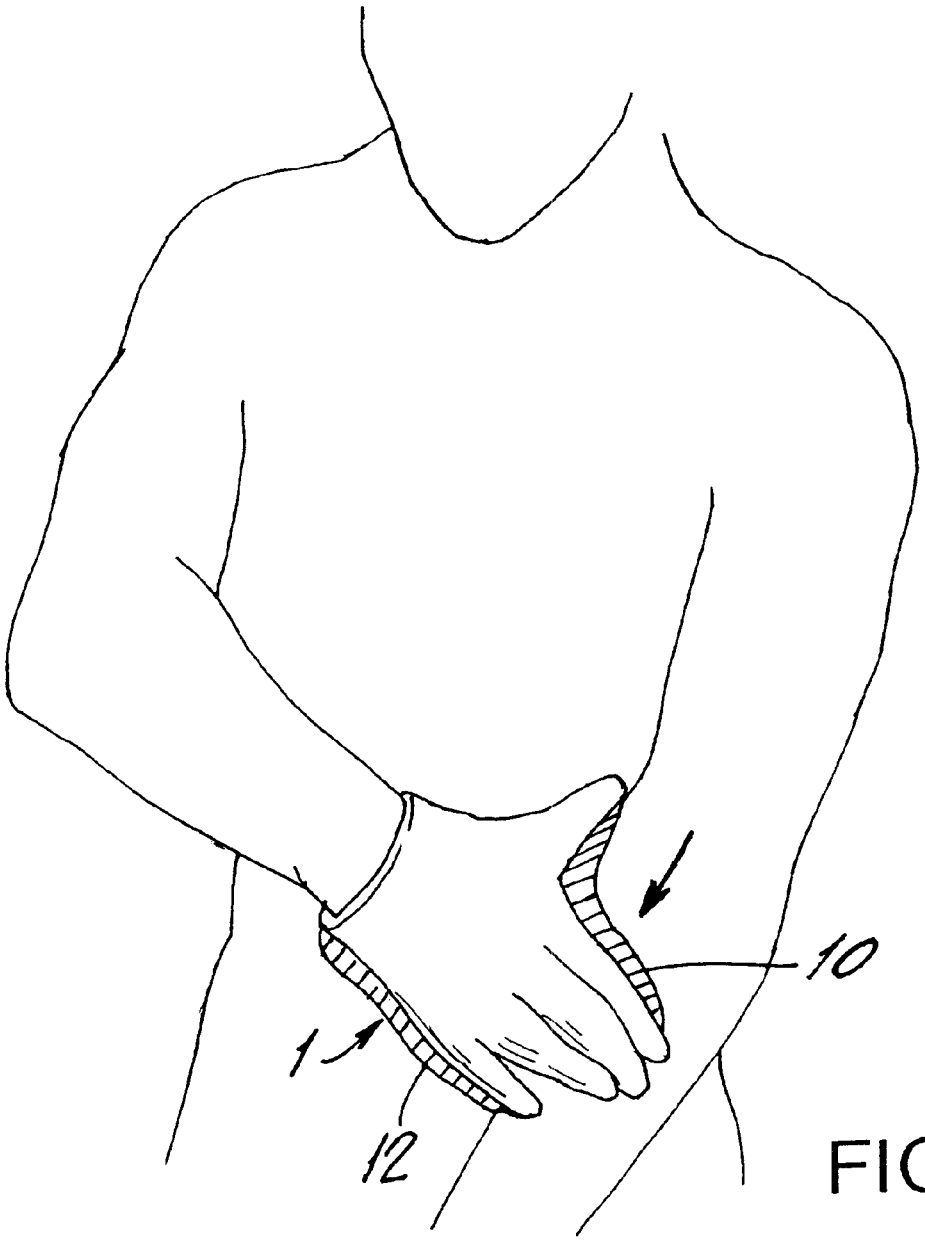
FIG. 2 is a diagram of a person drying their body using the concave band of the body squeegee.

Shown in FIG. 2 is a person drying their arms with body squeegee 1 using the concave squeegee band 10. The unique feature of the body squeegee 1 of the present invention is that it incorporates two squeegee bands 10 and 12. The concave squeegee band 10 is guided by the thumb and the forefinger and can be stretched to be almost linear or shaped to curve around a body part, such as an arm or leg. The adjusting of the shape of the concave squeegee band 10, allows the rubber of the squeegee band to snuggly wrap around an arm, leg, foot, or any convex surface of the body, and dry that surface more effectively and quickly because the squeegee band 10 maintains contact with the entire rounded surface.

Figure 3:
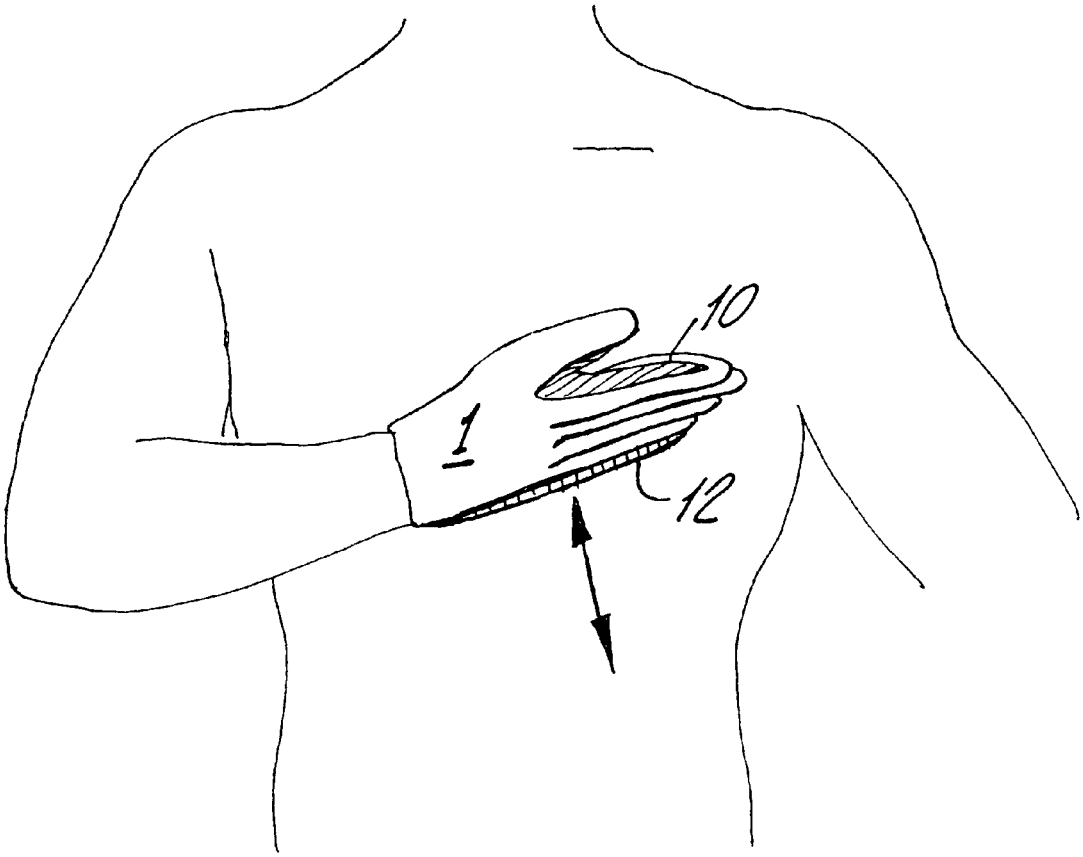
FIG. 3 is a diagram of a person drying their body using if the linear band of the body squeegee.

Shown in FIG. 3 is a person drying their stomach with the linear squeegee band 12. In order to use the linear squeegee band 12, the user flips their hand over so the palm is facing up, holds the hand flat, and wipes the skin with vertical strokes. This action resembles the use of a window squeegee cleaning windows, and just as the window squeegee is more efficient than paper towels at cleaning windows, the body squeegee 1 is more efficient than cloth towels at drying one's body. The linear squeegee band 12 allows the user to dry flat or convex surface areas of the body quickly without constantly stretching the thumb and forefinger to hold the concave squeegee band 10 flat enough against large skin surfaces for effective drying of that surface. The combination of the two squeegee bands 10 and 12 provide quick and effective drying of the entire body.

Figure 4:
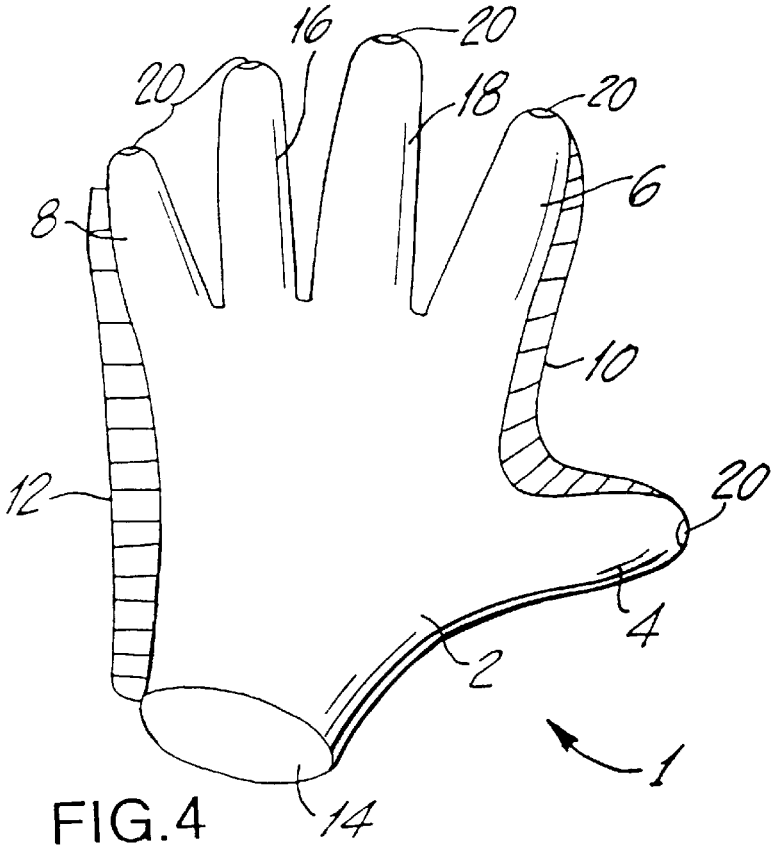
FIG. 4 is a diagram of a second embodiment of the present invention.

Shown in FIG. 4 is an alternate embodiment of the body squeegee 1 where the drainage holes 20 are not located on the top of the sleeves 4, 6, 18, 16, and 8 as shown in FIG. 1, but are located at the tip of the sleeves 4, 6, 18, 16, and 8.

Figure 5:
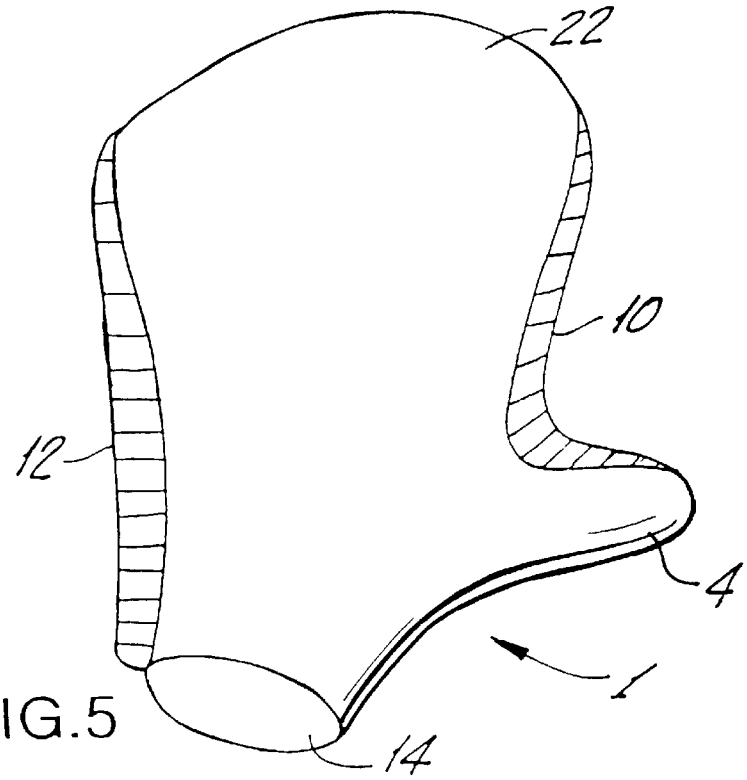
FIG. 5 is a diagram of a third embodiment of the present invention.

Shown in FIG. 5 is another alternate embodiment that shows the glove portion formed as a mitt. The thumb sleeve 4 is the same as the thumb sleeve 4 of FIG. 1, but the forefinger sleeve 6, the middle finger sleeve 18, the ring finger sleeve 16, and the pinky sleeve 8 are combined to form one large pocket 22 where all the user's fingers, except the thumb, reside during use.

It will be apparent to those skilled in the art that modifications to the specific embodiments described herein may be made while still being within the spirit and scope of the present invention. For example, the glove portion may have an inner liner for support, or the index, thumb, and pinky fingers could feature small, "V"-shaped rubber ridges on the underside. The ridges would gently rub against the skin and would effectively direct the water toward the body of the glove (the sponge-like material).

I claim:

1. A hand wearable body squeegee comprising:

a) a glove portion formed to substantially conform to a human hand, the glove portion comprising a body with an opening for inserting a human hand, a forefinger sleeve, a thumb sleeve, and a pinky sleeve all attached to the body so as to allow insertion of a human hand, b) a substantially concave squeegee band formed to contour substantially along the surface area between the forefinger sleeve and the thumb sleeve of the glove portion, and c) a substantially linear squeegee band formed along the surface area along the pinky sleeve and body towards the opening of the glove portion.

2. The body squeegee of claim 1 wherein the glove portion is constructed from water absorbent material.

3. The body squeegee of claim 2 wherein the water absorbent material is synthetic microporous PVA material.

4. The body squeegee of claim 1 further comprising two sleeves for a middle finger and a ring finger, both sleeves also attached to the body to allow each finger of a human hand to be inserted into an associated sleeve.

5. The body squeegee of claim 4 wherein the pinky sleeve, the ring finger sleeve, the middle finger sleeve, and the forefinger sleeve are joined to form a mitt.

6. The body squeegee of claim 1 wherein the thumb sleeve, pinky sleeve and forefinger sleeve each contain at least one hole for drainage.

7. The body squeegee of claim 6 wherein the hole of each sleeve is located in the area of the sleeve that covers the nail portion of a human hand.

8. The body squeegee of claim 6 wherein the hole of each sleeve is located at the end of the sleeve opposite the connection to the body.

9. The body squeegee of claim 1 wherein the squeegee bands are constructed from rubber.

* * * * *